US005927636A

United States Patent [19]

Rafflenbeul

[11] Patent Number: 5,927,636

[45] Date of Patent: Jul. 27, 1999

[54] YARN WINDING APPARATUS

[75] Inventor: Karl-Ludwig Rafflenbeul, Ennepetal, Germany

[73] Assignee: Barmag AG, Remscheid, Germany

[21] Appl. No.: 08/978,530

[22] Filed: Nov. 26, 1997

[30] Foreign Application Priority Data

Nov. 27, 1996 [DE] Germany ..... 196 49 104

[51] Int. Cl.[6] ..... B65H 54/00; H05K 7/20; H02M 7/44

[52] U.S. Cl. ..... 242/470; 242/474.4; 361/679; 361/715; 363/141

[58] Field of Search ..... 242/474.5, 474.4, 242/470, 485; 363/141, 144; 361/707, 704, 715, 679

[56] References Cited

U.S. PATENT DOCUMENTS

| | | | |
|---|---|---|---|
| 2,925,227 | 2/1960 | Hann et al. | 242/474.5 |
| 3,550,871 | 12/1970 | Keith | 242/474.4 |
| 4,609,160 | 9/1986 | Linderoth et al. | 242/470 |
| 5,029,762 | 7/1991 | Behrens et al. . | |
| 5,234,173 | 8/1993 | Nishikawa et al. | 242/474.5 |
| 5,246,177 | 9/1993 | Sugioka | 242/474.4 |
| 5,253,143 | 10/1993 | Klinger et al. | 361/679 X |
| 5,297,025 | 3/1994 | Shoquist et al. | 361/704 |
| 5,499,772 | 3/1996 | Maeda et al. | 242/470 X |
| 5,508,908 | 4/1996 | Kazama et al. | 361/715 X |
| 5,526,995 | 6/1996 | Westrich et al. . | |

FOREIGN PATENT DOCUMENTS 0 374 536 6/1990 European Pat. Off. .

OTHER PUBLICATIONS

Electronic systems Electronic components, Barmag Brochure, 6 pages.
Taiwan Patent Publication 102361, Aug. 1988.
Taiwan Patent Publication 52940, Sep. 1983.

*Primary Examiner*—Michael Mansen
*Attorney, Agent, or Firm*—Alston & Bird LLP

[57] ABSTRACT

A yarn winding apparatus for winding a plurality of continuously advancing yarns into cross wound packages, and which includes a rotatable revolver which mounts a pair of winding spindles which are alternately moved between a winding position and a doffing position. A beam-like carrier supports a yarn traversing mechanism and a sensor roll for each package being formed, and the drive electronics and the control electronics are combined in a control unit which is mounted on the outer end portion of the length of the carrier.

18 Claims, 4 Drawing Sheets

YARN WINDING APPARATUS

BACKGROUND OF THE INVENTION

The present invention relates to a yarn winding machine for winding a plurality of continuously advancing yarns onto bobbins to form cross wound yarn packages.

Yarn winding machines of the described type are known from EP 374 536 and corresponding U.S. Pat. Nos. 5,029,762. In such machines, a plurality of winding stations are disposed in a side by side relation along the length of the machine, and each winding station comprises a winding apparatus which includes a rotatable revolver which mounts two winding spindles, and a traversing device and sensor roll mounted on a projecting beam-like carrier. The drives for the winding spindle, the revolver, and the traversing device are controlled by drive electronics. The known winding machines also include electronic components which are used to control the winding process and the change of bobbins at each winding station. As is known, for example, from the applicant's brochure "Electronic systems, electronic components," such electronic components and the electrical equipment for controlling the drives are disposed in a control cubicle which is installed in the vicinity of the winding machine. Operation of the winding machine is however effected directly at the machine at an operator panel provided for that purpose. Experience has shown that, particularly for diagnostic purposes, such arrangement gives rise to the problem that the operator is unable to control the operating sequence of the machine from the control cubicle. Furthermore, an individual setting of the operating parameters is possible only to a qualified extent because the control-related parameters are input from a central machine controller of the winding machine.

It is accordingly an object of the present invention to provide a winding machine of the type described wherein the process control may be input, varied and checked by an operator centrally at each winding apparatus.

It is also an object of the invention to provide a winding apparatus of the described type which is as short and compact as possible.

SUMMARY OF THE INVENTION

The above and other objects and advantages of the invention are achieved in that the drive electronics and the control electronics of each winding apparatus of the machine are combined in a control unit which is arranged on the carrier so as to be distributed over a part of its length. The control electronics in the present case comprise the circuits, usually integrated on plug-in cards, and their components. The drive electronics substantially comprise the components, such as for example inverters, which are required for supplying power to the drives. By virtue of disposing the control unit on the carrier on which the operator panel for operating the winding machine is also disposed, central operation of the machine functions effected by the control electronics and drive electronics becomes possible. Fastening of the control unit on the carrier which also mounts the traversing device leads to a very compact and space-saving design of the winding machine. The control unit is fastened to the carrier in such a way that the vibrations arising in the carrier do not lead to faults in the electronic components mounted thereon.

A particularly advantageous development provides that substantially all of the electronic components of the winding machine are combined into the control unit, and wherein the control unit includes a central processing unit. The control unit is equipped with a power supply connection as well as with a data transfer connection. The advantage of the winding machine according to the invention is that control is effected by only one central processing unit. Thus, the winding machine may be individually programmed and operated independently of an external central machine controller. Such an arrangement is advantageous particularly for diagnostic and checking purposes.

As a result of combining all electronic functions in one unit there is no need for duplicate installation of subfunctions such as, for example, interface connections and power supply. All of the electronic functions of the winding machine are therefore controlled exclusively by the central processing unit. The interface connection to an external central machine controller, which monitors the winding machines of an installation, exists only for data communication.

The arrangement of the control unit at the attendance side of the machine is particularly advantageous in that not only attendance but also diagnosis may be effected directly from the operator panel. In such case, the diagnostic information may be displayed directly on the display unit of the operator panel.

Such arrangement additionally leads to a considerable increase in machine safety since all of the activities to be carried out by the operator may be undertaken immediately at the front of the winding machine. The area at the longitudinal side of the winding head, which is particularly dangerous because of the rotating parts, does not have to be crossed by the operator.

A further advantageous development of the winding machine provides that the power electronics and the control electronics are disposed in a separately encapsulated manner in the control unit. It is therefore possible to achieve electric screening, thereby preventing a mutual influencing or interference, in particular preventing the power electronics from acting upon the control electronics.

The arrangement of the power electronics on a plate, which is in heat-conducting contact with a heat sink, or directly on the heat sink has the advantage that the heat loss may be removed at its point of origin directly to the environment. The heat sink in the present case may comprise a plurality of cooling ribs for generating the largest possible cooling surface. For increasing the cooling action it is likewise advantageous to have a cooling air stream blown onto the heat sink.

The heat sink may advantageously be formed directly on the carrier. For example, the heat sink could be a cover which closes off a hollow carrier containing the control unit.

Designing the carrier as a channel section provides an installation space for the control unit without an additional housing.

A further advantageous construction of the winding machine makes it possible for the yarn breakage stop motion installed at each winding location to be connected directly by a signal line to the central processing unit of the control unit. Evaluation of the signals is therefore effected directly in the winding machine so that there may be a correspondingly rapid reaction to yarn breakages. The wiring outlay for monitoring the yarn breakage stop motions is moreover minimized since there is no need for an interface connection to the external central machine controller.

BRIEF DESCRIPTION OF THE DRAWINGS

Further advantages and specific features of the present invention are described in more detail below with reference to the accompanying drawings, in which.

DETAILED DESCRIPTION OF THE PREFERRED EMBODIMENTS

Figure 1:
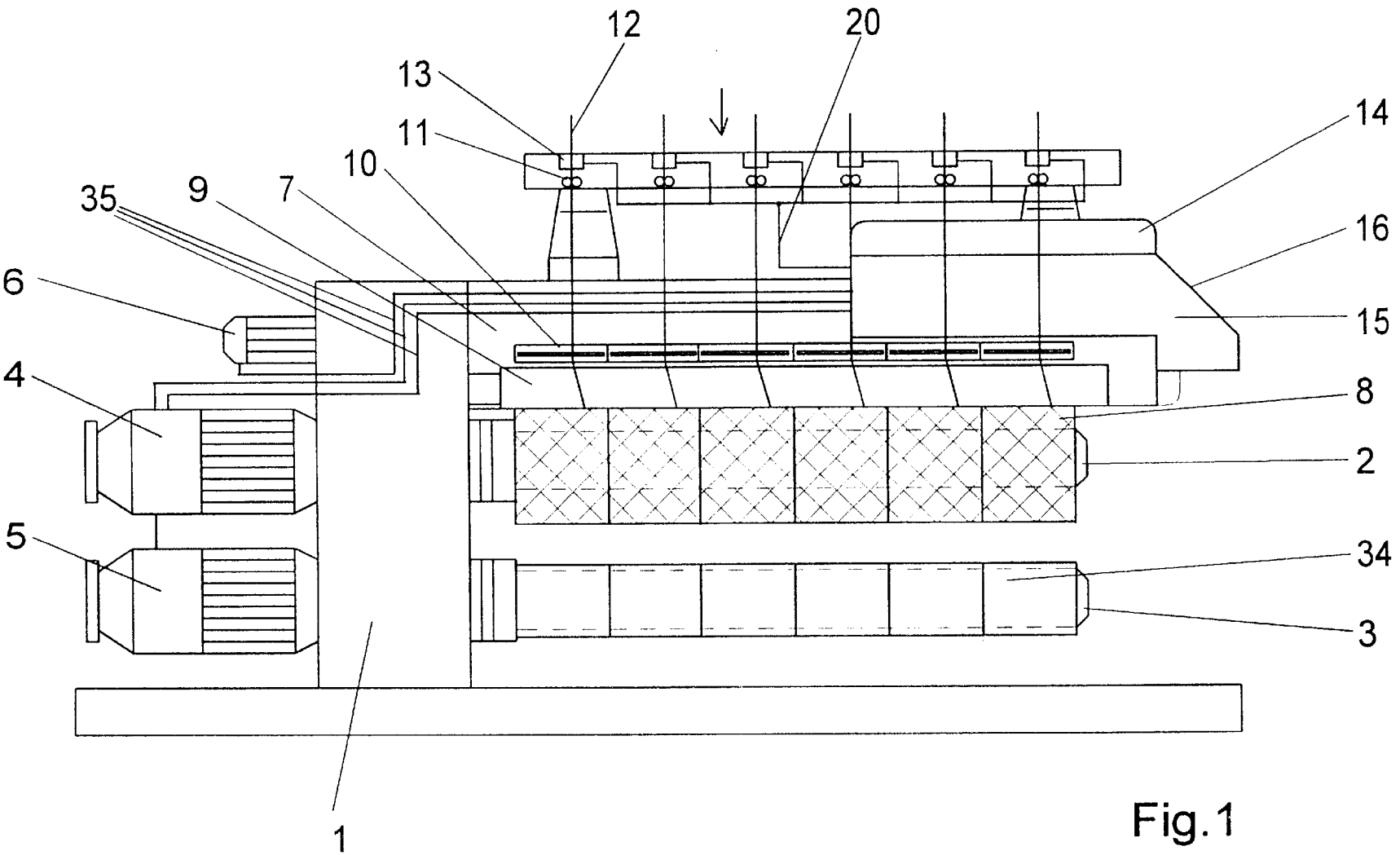
FIG. 1 is a diagrammatic side elevation view of a winding machine with a control unit in accordance with the present invention

Referring more particularly to the drawings, FIG. 1 illustrates a winding machine in accordance with the present invention, and which includes a rotatable spindle revolver (not shown) which is supported in the machine frame 1. A revolver of this type is illustrated and described in U.S. Pat. Nos. 5,029,762 and 5,526,995, the disclosures of which are incorporated by reference. The spindle revolver is rotated by means of the revolver drive 6. On the spindle revolver, the winding spindles 2 and 3 are rotatably supported in a projecting manner. The winding spindle 2 in the present case is driven by the spindle motor 4, and the winding spindle 3 is driven by the spindle motor 5. The packages 8 are wound on the winding spindle 2. To this end, at each winding location a yarn 12 runs via a top yarn guide 11 to a traversing device 10. Installed upstream of the top yarn guide 11 is a yarn breakage stop motion 13. The traversing device is mounted to the beam-like projecting carrier 7.

Downstream of the traversing device, the yarn 12 runs across a pressure roller 9 and is deposited by the pressure roller 9 on the winding surface of the package 8. For this purpose, the yarn 12 is looped partially around the pressure roller 9. The pressure roller 9 is applied with a specific contact pressure against the winding surface of the bobbin 8. During winding, the spindle motor 4 is controlled in such a way that the peripheral speed of the bobbin remains constant. To such end, the peripheral speed of the pressure roller is continuously monitored for control purposes. The winding machine illustrated in FIG. 1 comprises a total of six winding locations which are all identical in construction so that the description applies equally to each winding location on the spindle of the machine.

A control unit 15 is fastened to the carrier 7. The control unit 15 is in heat conducting contact with a heat sink 14. At the attendance side of the winding machine, where the full packages 8 after being fully wound are exchanged for empty bobbin tubes, the control unit 15 has an operator panel 16. The control unit is connected to the drives 4, 5 and 6 by the lines 35. The traversing drive and a drive of the pressure roller are likewise connected to the control unit. A signal line 20 is connected to each yarn breakage stop motion 13 and leads to the control unit.

In the illustrated operating position of the winding machine of FIG. 1, the winding spindle 2 is in the winding position. The winding spindle 3 with the mounted empty bobbin tubes 34 is in a stand-by or doffing position. As soon as the packages 8 on the winding spindle 2 have been fully wound, the positions of the winding spindles 2 and 3 are reversed by rotating the revolver.

Figure 2:
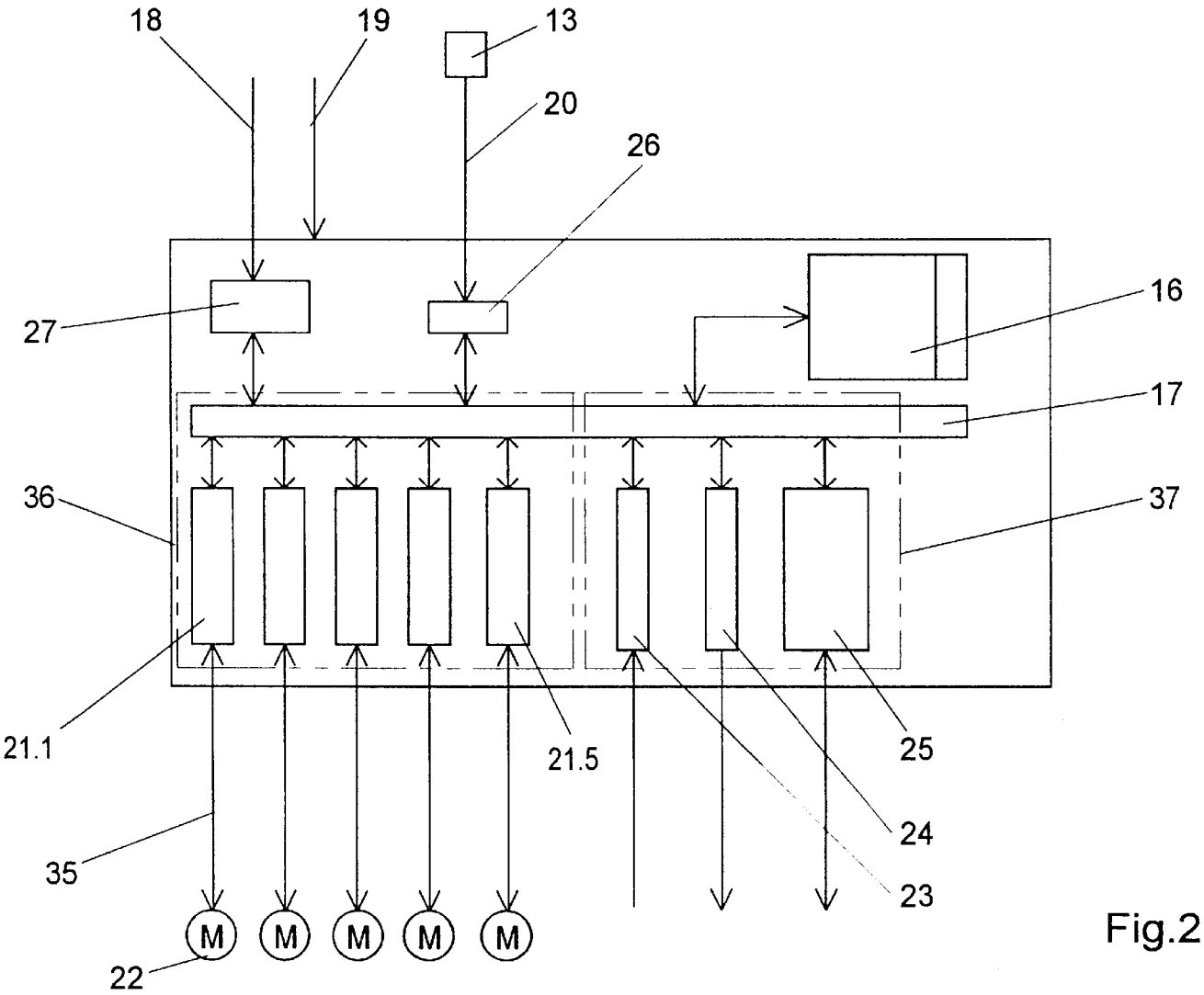
FIG. 2 is a diagrammatic block diagram of the control unit of FIG. 1.

In FIG. 2 a schematic block diagram of the control unit 15 from FIG. 1 is shown. In the present case, the drive electronics 36, the control electronics 37 and the operator panel 16 are combined. The drive electronics 36 substantially comprise the components for supplying power to the drives, the inverters inside the drive electronics being combined into a power electronics unit. The control electronics substantially comprise the circuits for controlling the machine functions as well as the circuits for the data link to an external machine controller which, for example, controls and monitors an entire winding process. In the present case, the circuits may take the form of individual control cards. The core component of the control unit 15 is the central processing unit 17 which controls both the drive electronics 36 and the control electronics 37. The central processing unit 17 is connected by a connector 27 to a signal line 18. The signal line 18 leads to the central machine controller. By such means, machine data and process data are relayed to the central machine controller. Such data are needed in particular for overall computer-based process and transport control.

The central processing unit 17 is moreover connected by the connector 26 to the signal line 20. The signal line 20 connects the yarn breakage stop motion 13 to the central processing unit 17. Power is supplied to the control unit 15 through the line 19. The central processing unit 17 then takes over control of all of the electrical functions of the winding head. For this purpose, the inverters 21.1 to 21.5 are coupled to the central processing unit 17. The drives 22 are activated by means of the inverters. The interface connection of the drives 22 is effected by the line 35. As drives in the winding head, in the present case the drives of the winding spindle and the revolver already illustrated in FIG. 1 are activated. The drives of the traversing device and the pressure roller are moreover controlled by this means. The central processing unit 17 is likewise connected to a signal input 23 and a signal output 24. By this means the interface connection of sensors and actuators of the winding machine is effected. An analog input/output 25 is provided for analog data communication. The analog input/output could be used, for example, to interface a contact pressure control device of the pressure roller. The central processing unit 17 is further coupled to the operator panel 16. By virtue of this integration of the electronic components it is easily possible to carry out a diagnosis (process sequence, control sequence, trouble shooting) at the integrated operator panel. The central processing unit 17 takes over the complete electronic interface connection of the winding head.

Figure 3:
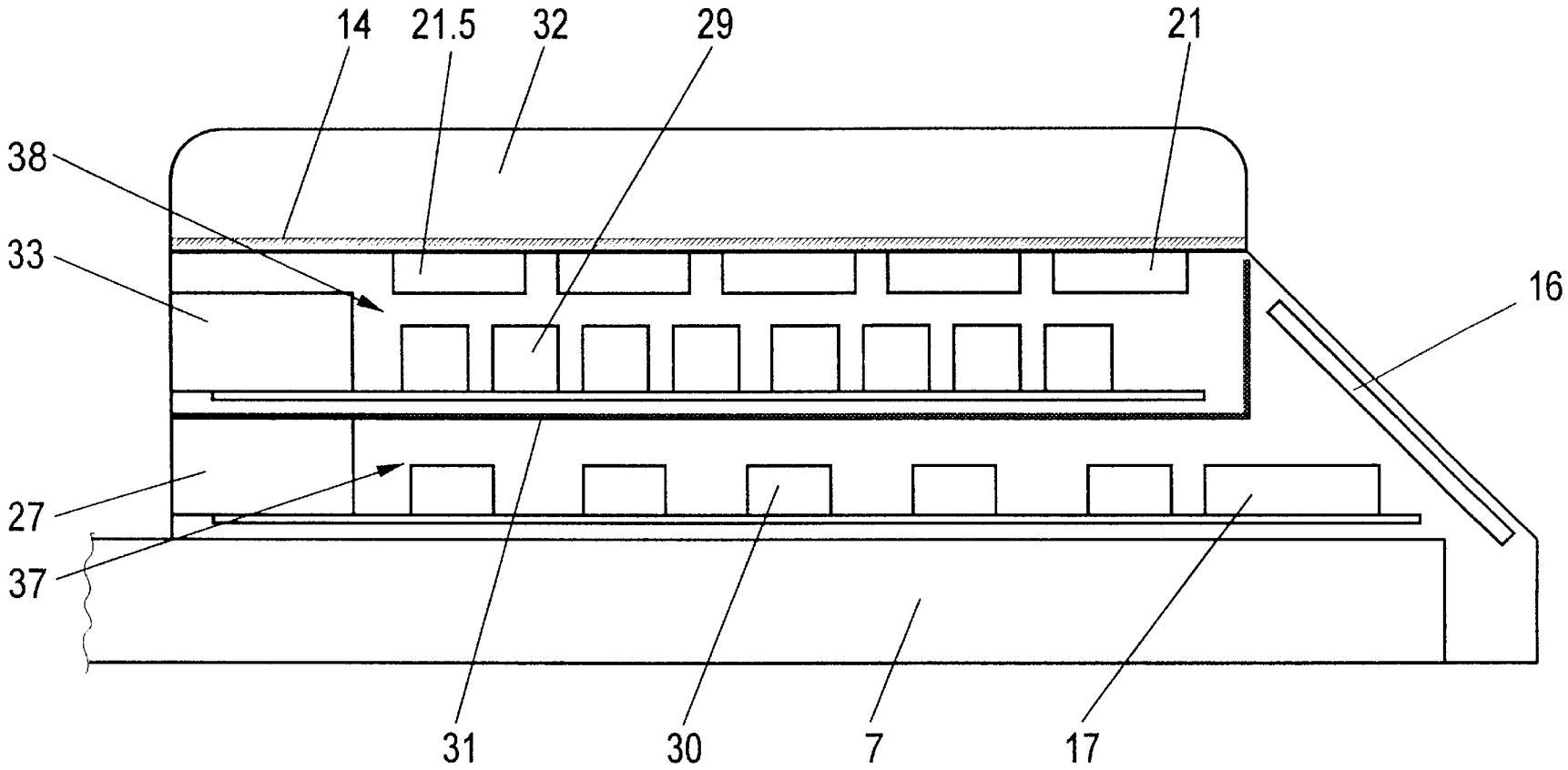
FIG. 3 is a diagrammatic illustration of the power electronics and control electronics inside the control unit.

In FIG. 3 a longitudinal section of the control unit is diagrammatically illustrated. Here, inside the control unit a screening plate 31 is disposed between the power electronics 38 and the control electronics 37. Inside the power electronics 38 the power semiconductors or the inverters 21.1 to 21.5 are fastened to a heat sink 14. At its opposite side to the power electronics the heat sink 14 has cooling ribs 32 which are aligned parallel to one another. The interface connection of the winding head components is effected by means of the connector 33 which is disposed inside the power electronics. The power electronics 38 further comprise the power modules 29 which are used as an inverter module for activation of the drives. The control electronics 37 are situated at the side directed towards the carrier 7. The control electronics 37 comprise the control cards 30 as well as the central processing unit 17. The operator panel 16 is likewise disposed in the region of the control electronics. Data input and/or output is effected by means of the connector 27.

In the described arrangement, all sensor and motor lines are brought together in one connector part 33. All internal winding head connections are therefore established without additional screw terminals. At the intended installation point, the fully pre-tested control unit is inserted and locked on the carrier.

Figure 4:
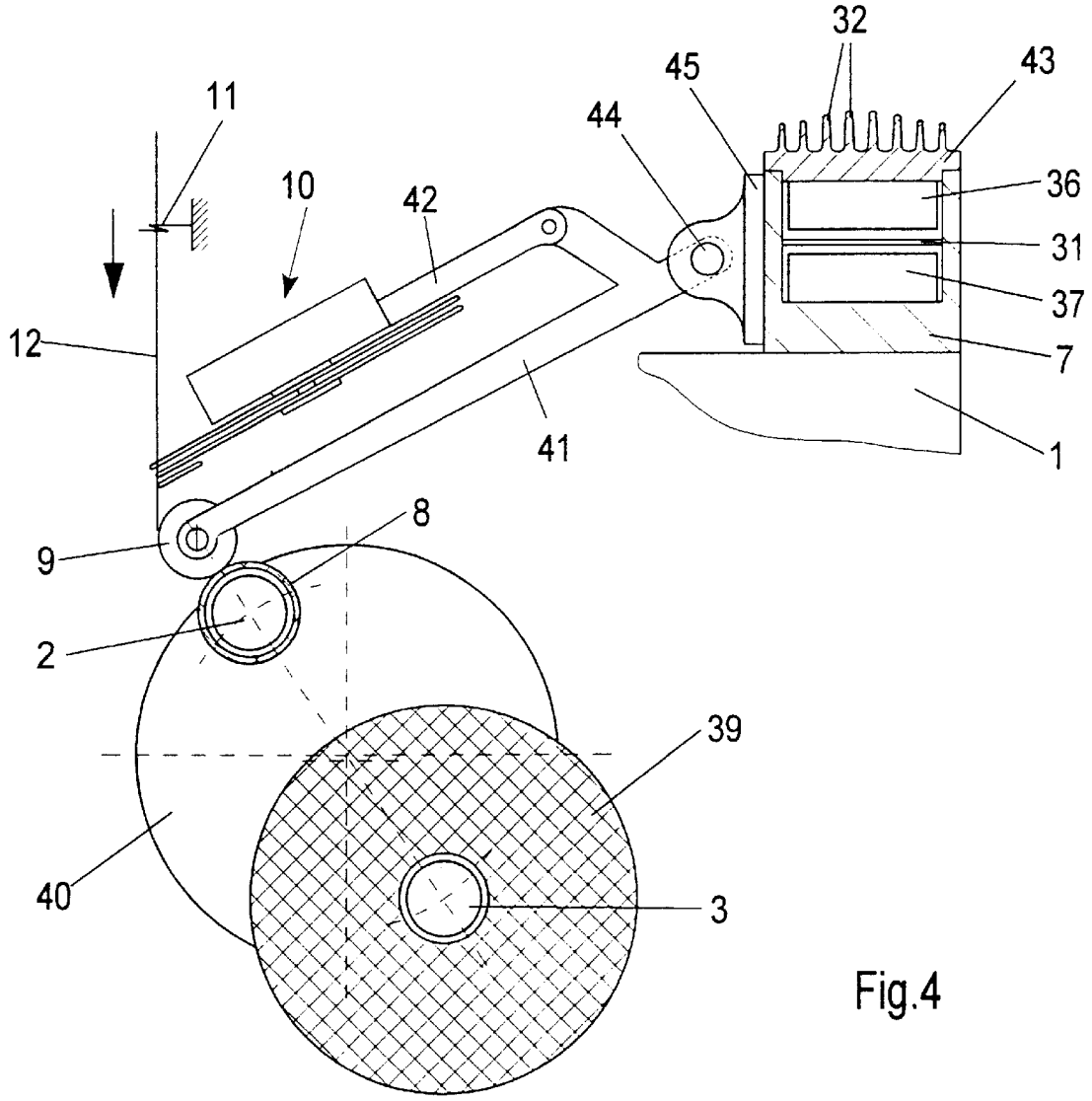
FIG. 4 is a diagrammatic front view of a continuous yarn winding apparatus which includes a rotatable revolver, and which includes a control unit in accordance with the present invention.

FIG. 4 shows a further embodiment of a winding head according to the invention with a control unit. The mechanical construction of the winding head is substantially identical to the construction of the winding head of FIG. 1. Functionally identical components have therefore been given identical reference characters. Reference is likewise made to the description of FIG. 1, and the disclosures of U.S. Pat. Nos. 5,029,762 and 5,526,995.

The winding head comprises a machine frame 1 which is connected to a substantially horizontally projecting carrier 7. Fastened to the carrier 7 is a plate 45 used to mount a traversing device 10 and a pressure roller 9. The pressure roller 9 is rotatably supported on one end of a rocker 41, and the rocker 41 is coupled to the plate 45 by a swivel bearing 44. Disposed on the rocker 41 is the carrier 42 which carries the traversing device 10.

The pressure roller 9 is applied against a bobbin 8 which is to be wound. The bobbin 8 is mounted on a driven winding spindle 2. The winding spindle 2 is rotatably supported in a projecting manner on a winding revolver 40. On the winding revolver 40 a further winding spindle 3 is rotatably supported in a projecting manner and eccentrically offset by 180° relative to the winding spindle 2. The winding spindle 3 carries a full package 39.

The carrier 7 is shown in cross section in FIG. 4, and it has a U-shaped cross section so as to define an internal channel. Disposed between the side walls of the U-shaped carrier 7 are the drive electronics 36 and the control electronics 37, in each case in the form of an electronic unit. In the present case, the unit of the control electronics 37 is fastened to the bottom of the channel of the carrier 7. The unit of the drive electronics 36 is fitted at the opposite side on a cover 43. The cover 43 is disposed on the free ends of the side walls of the carrier 7 and so that the carrier 7 forms a closed inner chamber. An insulating wall 31 is disposed between the drive electronics 36 and the control electronics 37. By means of the insulating wall 31 both electromagnetic screening and thermal insulation are achieved between the drive electronics 36 and the control electronics 37. The cover 43 is designed as a heat sink, on the outside of which a plurality of cooling ribs 32 are formed.

The interface connection of the drive electronics and the control electronics to the electronic equipment such as sensors and actuators disposed outside of the units is not shown in FIG. 4.

The operator panel is likewise disposed in the vicinity of the control electronics 37. The drive electronics 36 and the control electronics 37 are coupled to one another by plug-in connections. Thus, all of the machine functions may be controlled from a central position.

In the construction shown in FIG. 4, the electronic units of the drive electronics 36 and the control electronics 37 are provided one on top of the other in the carrier 7. In principle, the electronic units may alternatively be fastened in a longitudinal direction one behind the other on the carrier 7.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for winding a plurality of advancing yarns to form wound packages, and comprising a winding spindle upon which a plurality of bobbin tubes can be coaxially mounted, and a spindle drive for rotating the winding spindle, a beam-like carrier mounted immediately adjacent the winding spindle so as to extend generally parallel thereto and along the length of the winding spindle, a plurality of yarn traversing devices mounted to said carrier for traversing respective yarns and forming a wound yarn package on each of the bobbin tubes, and a control unit mounted on said carrier and including (a) a drive electronics unit for supplying power to the spindle drive, (b) a control electronics unit for controlling the operation of the winding apparatus, and (c) an operator panel for controlling the drive electronics unit and the control electronics unit.

2. The winding apparatus as defined in claim 1 wherein said control unit further includes a power supply connection, a signal transfer connection, and a central processing unit connected between said operator panel and said drive electronics unit and said control electronics unit.

3. The winding apparatus as defined in claim 2 wherein said winding spindle defines an outer free end, said beam-like carrier has an outer end portion which is generally aligned with the outer free end of the winding spindle, and said control unit is mounted on the outer end portion of the carrier.

4. The winding apparatus as defined in claim 3 wherein said drive electronics unit comprises at least one inverter which is connected to said spindle drive, and wherein said drive electronics unit and said control electronics unit are separately enclosed in a control console.

5. The winding apparatus as defined in claim 4 wherein the control console further includes a heat sink, and wherein the drive electronics unit is operatively connected to the heat sink.

6. The winding apparatus as defined in claim 1 wherein said carrier includes a channel of U-shaped cross-section so as to define parallel outer side walls, and wherein the drive electronics unit and the control electronics unit are disposed in said channel between the outer side walls thereof.

7. The winding apparatus as defined in claim 6 wherein said carrier further includes a cover which is in the form of a heat sink and which overlies the channel.

8. The winding apparatus as defined in claim 1 further comprising a yarn breakage stop motion device which is connected by a signal line to said central processing unit.

9. The winding apparatus as defined in claim 1 further comprising a screening plate interposed between said control electronics unit and said drive electronics unit.

10. The winding apparatus as defined in claim 1 further comprising a pressure roller mounted to said carrier so as to engage at least one of the wound yarn packages which is being formed on the winding spindle.

11. An apparatus for continuously winding a plurality of advancing yarns onto bobbin tubes to form wound packages, and comprising, a revolver mounted for rotation about a central axis and which rotatably mounts two spindles which are rotatable about respective axes which are parallel to said central axis, a revolver drive for selectively rotating the revolver so as to alternately move the spindles between a winding position and a doffing position, a spindle drive for rotating each of said spindles about their respective axis, a beam-like carrier mounted immediately adjacent said revolver so as to extend in a direction generally parallel to said central axis and along the lengths of the winding spindles, a plurality of yarn traversing devices mounted to said carrier for traversing the advancing yarns and forming wound yarn packages on respective bobbin tubes which are coaxially mounted on one of the spindles located at the winding position, and a control unit mounted on said carrier and including (a) a drive electronics unit for supplying power to the revolver drive and each of the spindle drives, (b) a control electronics unit for controlling the operation of the winding apparatus, and (c) an operator panel for controlling the drive electronics unit and the control electronics unit.

12. The winding apparatus as defined in claim 11 wherein said spindles define outer free ends which are aligned with each others said beam-like carrier has an outer end portion which is generally aligned with the outer free ends of the spindles, and said control unit is mounted within a control module which is mounted on the outer end portion of the carrier.

13. The winding apparatus as defined in claim 12 wherein said drive electronics unit and said control electronics unit are separated by means of a screening plate located in said control module.

14. The winding apparatus as defined in claim 13 wherein said control module further includes a heat sink which is operatively connected to said drive electronics unit.

15. The winding apparatus as defined in claim 11 wherein said carrier includes a channel of U-shaped cross-section so as to define parallel outer side walls, and wherein the drive electronics unit and the control electronics unit are disposed in said channel between the outer side walls thereof.

16. The winding apparatus as defined in claim 15 wherein said control electronics unit and said drive electronics unit are disposed one on top of the other in said channel, and further comprising a screening plate interposed between said control electronics unit and said drive electronics unit.

17. The winding apparatus as defined in claim 16 wherein said carrier further includes a cover which is in the form of a heat sink and which overlies the channel.

18. The winding apparatus as defined in claim 11 further comprising a pressure roller mounted to said carrier so as to engage at least one of the wound yarn packages which is being formed on one of the winding spindles at the winding position.

* * * * *

UNITED STATES PATENT AND TRADEMARK OFFICE

CERTIFICATE OF CORRECTION

PATENT NO. : 5,927,636

DATED : July 27, 1999

INVENTOR(S) : Rafflenbeul

It is certified that error appears in the above-identified patent and that said Letters Patent is hereby corrected as shown below:

Column 6, line 22, "claim 2" should read --claim 1--.

Column 7, line 19, "others" should read --other,--.

Signed and Sealed this

Twenty-fifth Day of January, 2000

*Attest:*

*Attesting Officer*

*Acting Commissioner of Patents and Trademarks*